US010208895B2

(12) United States Patent
Chun et al.

(10) Patent No.: US 10,208,895 B2
(45) Date of Patent: Feb. 19, 2019

(54) PUMP TOWER INSTALLATION STRUCTURE OF LIQUEFIED NATURAL GAS STORAGE TANK AND MANUFACTURING METHOD THEREOF

(71) Applicant: SAMSUNG HEAVY IND. CO., LTD., Seoul (KR)

(72) Inventors: Sang-Eon Chun, Geoje-si (KR); Dae-Jung Kim, Geoje-si (KR); Sung-Oh Park, Geoje-si (KR); Soo-Ho Lee, Geoje-si (KR); Ki-Hun Joh, Geoje-si (KR); Jeong-Oh Hwang, Gimhae-si (KR); Chang-Seon Bang, Geoje-si (KR)

(73) Assignee: Samsung Heavy Ind. Co., Ltd., Seoul (KR)

( * ) Notice: Subject to any disclaimer, the term of this patent is extended or adjusted under 35 U.S.C. 154(b) by 395 days.

(21) Appl. No.: 14/365,102

(22) PCT Filed: Nov. 20, 2012

(86) PCT No.: PCT/KR2012/009810

§ 371 (c)(1),
(2) Date: Jun. 12, 2014

(87) PCT Pub. No.: WO2013/089359

PCT Pub. Date: Jun. 20, 2013

(65) Prior Publication Data

US 2015/0033769 A1 Feb. 5, 2015

(30) Foreign Application Priority Data

Dec. 16, 2011 (KR) ..... 10-2011-0136772
Nov. 2, 2012 (KR) ..... 10-2012-0123719

(51) Int. Cl.
*F17C 1/12* (2006.01)
*F17C 13/00* (2006.01)
(Continued)

(52) U.S. Cl.
CPC ..... *F17C 13/00* (2013.01); *B63B 19/00* (2013.01); *B63B 25/16* (2013.01); *B63B 27/24* (2013.01);
(Continued)

(58) Field of Classification Search
CPC ..... F17C 2205/0352; F17C 2205/0355; F17C 2205/0367; F17C 13/001; F17C 1/12;
(Continued)

(56) References Cited

U.S. PATENT DOCUMENTS 646,459 A * 4/1900 Place ..... F17C 3/08 220/560.1
2,274,913 A 3/1942 Wheeler
(Continued)

FOREIGN PATENT DOCUMENTS

DE 28 21 191 11/1979
EP 1 847 758 10/2007
(Continued)

OTHER PUBLICATIONS

Extended European Search Report dated Jan. 11, 2016 for European Patent Application No. 12857255.9.
(Continued)

*Primary Examiner* — Stephen Castellano
(74) *Attorney, Agent, or Firm* — Ladas & Parry, LLP

(57) ABSTRACT

Disclosed herein are a pump tower installation structure of a liquefied natural gas (LNG) storage tank and a manufacturing method thereof. The pump tower installation structure of the LNG storage tank includes an adaptor disposed at a predetermined area of an opening portion formed at an inner hull disposed on an upper side of the LNG storage tank, and a cover having through-holes corresponding to pipes of the
(Continued)

pump tower installed at the storage tank, and disposed at a remaining area of the opening portion to be connected with the adaptor.

9 Claims, 7 Drawing Sheets

(51) Int. Cl.
*B63B 25/16* (2006.01)
*B63B 27/24* (2006.01)
*F17C 3/04* (2006.01)
*B63B 19/00* (2006.01)
*E04H 7/02* (2006.01)

(52) U.S. Cl.
CPC ..... *F17C 3/04* (2013.01); *E04H 7/02* (2013.01); *F17C 2201/052* (2013.01); *F17C 2203/035* (2013.01); *F17C 2205/0355* (2013.01); *F17C 2209/227* (2013.01); *F17C 2209/232* (2013.01); *F17C 2223/0161* (2013.01); *F17C 2223/033* (2013.01); *Y10T 29/49826* (2015.01)

(58) Field of Classification Search
CPC ..... F17C 2223/0161; F17C 2209/232; B63B 27/24; B63B 19/00; B63B 25/16
USPC ..... 220/560.11, 560.15, 565, 560.12
See application file for complete search history.

(56) References Cited

U.S. PATENT DOCUMENTS 2,594,244 A * 4/1952 Winternitz ..... F17C 3/022 220/560.03
2,933,902 A * 4/1960 Howard ..... B63B 25/16 114/74 A
2,986,011 A * 5/1961 Murphy ..... B63B 25/16 114/74 A
2003/0057214 A1 3/2003 Miller et al.
2008/0197137 A1* 8/2008 Schlag ..... F17C 3/08 220/560.12
2016/0252213 A1* 9/2016 Kanno ..... F17C 13/12 220/560.08
2017/0219166 A1* 8/2017 Jin ..... B63B 25/16

FOREIGN PATENT DOCUMENTS

GB 725477 3/1955
JP 44-29713 12/1969
JP 2002-145387 5/2002
JP 2004-28238 A 1/2004
KR 20-0260147 Y1 1/2002
KR 10-2009-0102969 10/2009
KR 10-2011-0026945 3/2011
KR 10-1019178 B1 3/2011
WO 2009/102262 8/2009

OTHER PUBLICATIONS

Office Action dated Apr. 21, 2015 for Japanese Patent Application No. 2014-545803.
International Search Report for mailed on PCT/KR2012/009810 and its translation thereof dated Mar. 26, 2013.
Office Action dated Oct. 26, 2017 for European Patent Application No. 12857255.9.
International Preliminary Report on Patentability (Chapter II) dated Feb. 25, 2014 for PCT/KR2012/009810 and its English translation from WIPO.
Written Opinion of the International Search Authority dated Mar. 26, 2013 for PCT/KR2012/009810 and its English translation by Google machine translate.

* cited by examiner

PUMP TOWER INSTALLATION STRUCTURE OF LIQUEFIED NATURAL GAS STORAGE TANK AND MANUFACTURING METHOD THEREOF

CROSS-REFERENCE TO RELATED APPLICATIONS

This application is the U.S. National Stage of International Patent Application No. PCT/KR2012/009810 filed on Nov. 20, 2012, which claims priority to Korean Patent Application No. 10-2011-0136772 filed on Dec. 16, 2011 and Korean Patent Application No. 10-2012-0123719 filed on Nov. 2, 2012, the disclosures of which are hereby incorporated by reference in their entireties.

TECHNICAL FIELD

Embodiments of the present invention relate to a pump tower installation structure of a liquefied natural gas (LNG) storage tank and a manufacturing method thereof.

BACKGROUND ART

An LNG storage tank of an LNG carrier generally stores LNG cooled to a temperature of approximately −163° C., and thus is manufactured of a material which may withstand cryogenic temperatures, and has an insulation structure which is strong against thermal stress and thermal contraction and may prevent heat penetration. The LNG storage tank includes a primary barrier, an upper insulation board, a secondary barrier and a lower insulation board which are arranged in turn from an inner side of the storage tank toward an outer side thereof, and is provided to be coupled with an inner hull.

The storage tank has a pump tower for loading and unloading LNG. The pump tower is configured of a pipe structure having a plurality of pipes. The pipes of the pump tower are uprightly installed in a direction passing through an upper surface of the storage tank. At this time, lower portions of the pipes are disposed to face a bottom surface in the storage tank, and upper portions thereof are installed to protrude above the storage tank and to be fixed to a hull.

Generally, each pipe of the pump tower is fixed to an outer hull when fixed to the hull. As an example, Korean Patent Publication No. 10-2011-0026945 (published on Mar. 16, 2011, hereinafter referred to as "a previous document") discloses a pump tower installation technology in which the upper portions of the pipes are fixed to a trunk deck corresponding to the outer hull and then finished.

However, in this case, since a heat isolating process should be additionally performed in a space formed between the outer hull and the inner hull, a pipe fixing structure and a fixing process may be complicated. Further, since it is difficult to smoothly finish around the secondary barrier disposed between the inner hull and the primary barrier, a leakage problem may occur. Further, since a gas-tight seal portion configured to wrap around the pipes protruding above the outer hull is exposed to an outside of the outer hull, efficiency of adjacent space may be lowered, and the gas-tight seal portion may be easily exposed to various external shocks.

DISCLOSURE

Technical Problem

Therefore, it is an aspect of the present invention to provide a pump tower installation structure of an LNG storage tank, in which pipes of the pump tower may be effectively fixed and installed, and a manufacturing method thereof.

Technical Solution

In accordance with one aspect of the present invention, a pump tower installation structure of an LNG storage tank includes an adaptor disposed at a predetermined area of an opening portion formed at an inner hull disposed on an upper side of the LNG storage tank, and a cover having through-holes corresponding to pipes of the pump tower installed at the storage tank, and disposed at a remaining area of the opening portion to be connected with the adaptor.

The adaptor may be formed of a flat plate, one side of the adaptor may be connected to the inner hull, and the cover may be disposed at the remaining area of the opening portion formed between the other side of the adaptor and the inner hull.

The adaptor may be formed in a frame shape having a cover hole portion to which the cover is bonded, and fixedly installed at a peripheral portion of the opening portion.

The cover may have a cover insulation board provided thereunder and formed under the opening portion, and the peripheral portion of the cover insulation board is insulated.

The cover insulation board may include a plurality of insulation blocks, and the insulation block may include a first protective plate, an insulation member provided under the first protective plate, and a second protective plate attached under the insulation member.

An adhesive layer and an adjustment protective plate attached under the second protective plate by the adhesive layer may be provided under the second protective plate.

The pump tower installation structure may further include an insulation layer disposed between the cover insulation board and a lower insulation board provided under the inner hull.

The pump tower installation structure may further include a vertical closing portion vertically installed under the adaptor, and an adjustment closing portion fixedly installed at the vertical closing portion to be disposed on the same plane with the insulation layer.

The adjustment closing portion may have an L-shaped cross section.

The pump tower installation structure according to claim 8, further comprising a subsidiary secondary barrier overlapping the adjustment closing portion and a main secondary barrier provided under the lower insulation board, and a connection board disposed under at least one of the main secondary barrier, the subsidiary secondary barrier and the insulation layer such that the connection board is disposed on the same plane with the upper insulation board under the main secondary barrier.

A primary barrier may be stacked on a lower surface of the upper insulation board, the connection board and the cover insulation board which are on the same plane.

Contact portions of the adaptor, the inner hull and the cover may be bonded by a welding operation.

In accordance with another aspect of the present invention, a method of manufacturing a pump tower installation structure of a liquefied natural gas (LNG) storage tank includes the steps of: (a) disposing the adaptor at the predetermined area of the opening portion, (b) disposing the cover having the cover insulation board provided thereunder, which is formed downward from the opening portion, at the remaining area of the opening portion, and (c) performing an operation of installing at least one barrier and an insulation operation at the peripheral portion of the cover insulation board.

The adaptor may be formed of a flat plate, one side of the adaptor may be connected to the inner hull, and the cover may be disposed at the remaining area of the opening portion formed between the other side of the adaptor and the inner hull.

The adaptor may be formed in a frame shape having a cover hole portion to which the cover is bonded, and fixedly installed at a peripheral portion of the opening portion.

The step (c) may include vertically welding the vertical closing portion under the adaptor, disposing the insulation layer between the cover insulation board and the lower insulation board provided under the inner hull, and fixing the adjustment closing portion to the vertical closing portion to be disposed on the same plane with the insulation layer.

The disposing of the insulation layer may include bonding a first insulation block of the insulation layer under the adaptor to be in contact with the vertical closing portion, and disposing a second insulation block of the insulation layer between the first insulation block and the lower insulation board or between the first insulation block and the cover insulation board.

The method may further include bonding the subsidiary secondary barrier to overlap the main secondary barrier and the adjustment closing portion which are provided under the lower insulation board, disposing the connection board under at least one of the main secondary barrier, the subsidiary secondary barrier and the insulation layer to be disposed on the same plane with the upper insulation board under the main secondary, and stacking the primary barrier on the lower surfaces of the cover insulation board, the connection board and the upper insulation board which are on the same plane.

Advantageous Effects

In the pump tower installation structure of the LNG storage tank according to the embodiment of the present invention and the manufacturing method thereof, the pipes of the pump tower can be effectively fixed and installed at the opening portion formed at the inner hull by the cover and the adaptor.

Further, since the peripheral portion of the cover insulation board under the cover, which is formed downward from the opening portion, is insulated, the insulation structure of the storage tank can be effectively finished in the inner hull.

Further, since the adaptor provided to correspond to the remaining area of the opening portion other than the area occupied by the opening portion is installed at the area (gap) generated between the inner hull and the cover, the tolerance problem between the inner hull and the cover can be effectively solved.

MODES OF THE INVENTION

Figure 1:
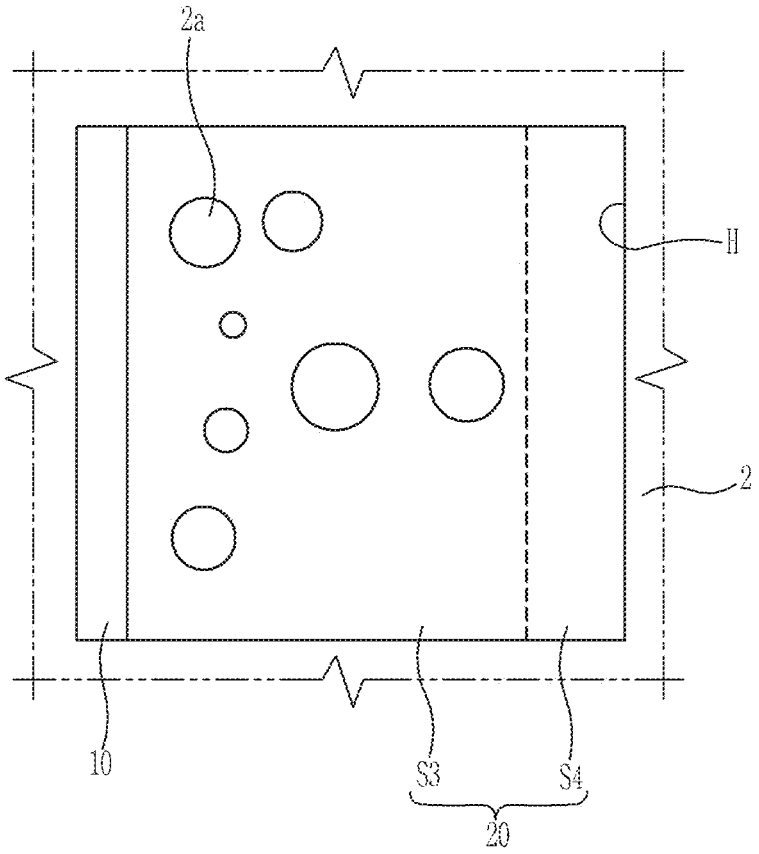
FIG. 1 is a plane view of a pump tower installation structure of an LNG storage tank in accordance with a first embodiment of the present invention.

Hereinafter, the embodiments of the present invention will be described in detail with reference to accompanying drawings. However, it is understood that the embodiments are provided as examples to teach the broader inventive concept, and one of ordinary skill in the art can easily apply the teaching of the present disclosure to other methods or apparatus. The present invention is not limited to the embodiments, and it should be understood that the present invention comprises all equivalents and substitutes included in the technical scope and spirit of the invention. In order to clearly illustrate the invention, parts not related to the description are omitted from the drawings. In the drawings, widths, lengths, thicknesses or the like of construction elements shown in the drawings may be exaggeratedly illustrated for the sake of convenience and clarity. The same reference numerals are given to the same or corresponding parts.

Figure 2:
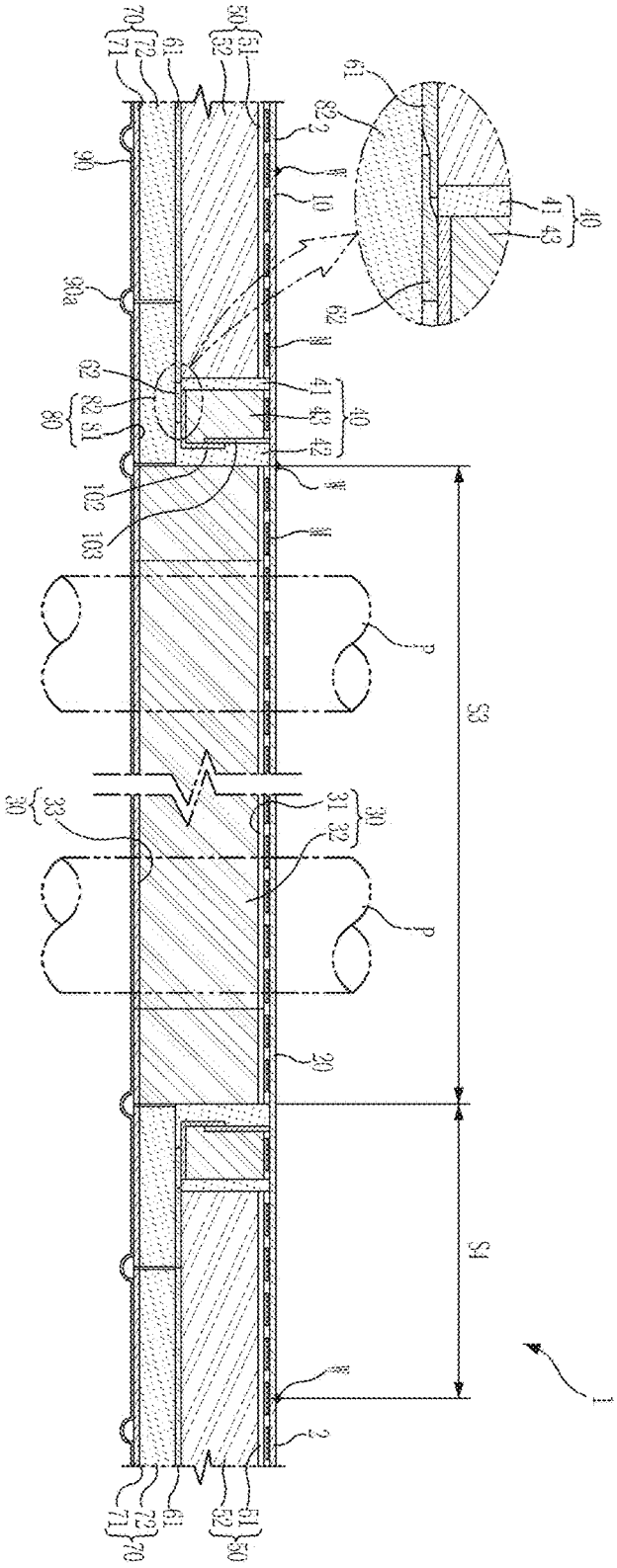
FIG. 2 is a cross-sectional view of the pump tower installation structure of the LNG storage tank of FIG. 1.

FIG. 1 is a plane view of a pump tower installation structure of an LNG storage tank in accordance with a first embodiment of the present invention, and FIG. 2 is a cross-sectional view of the pump tower installation structure of the LNG storage tank of FIG. 1.

As illustrated in FIGS. 1 and 2, an LNG storage tank 1 (hereinafter referred to as "storage tank") according to an embodiment of the present invention has an opening portion H formed at an upper inner hull 2, and a pump tower installed through the opening portion H. The pump tower may be generally configured of a pipe structure having a plurality of pipes, for example, a pipe structure having a plurality of pipes P including two discharge pipes and one filling pipe for loading and unloading liquid cargo, and one emergency pipe. To install the pump tower, the pump tower installation structure of the storage tank 1 according to the embodiment of the present invention includes an adaptor 10, a cover 20, an insulation layer 40, and an adjustment closing portion 102.

The adaptor 10 according to the first embodiment of the present invention is disposed at a predetermined area 51 (referring to FIG. 4) of the opening portion H, and may be formed of a flat plate of which one side is connected to the inner hull 2. Hereinafter, an example in which the adaptor 10 is connected with the inner hull 2 disposed at a stern side is described, but as another example, one side of the adaptor 10 may be connected with the inner hull 2 disposed at a stem side. Here, the inner hull 2 disposed at the stern side may be formed at a corner side of the storage tank 1.

The adaptor 10 may be previously manufactured to correspond to a remaining area of the opening portion H other than the area occupied by the cover 20 in the opening portion H. This is to effectively solve a tolerance problem between the cover 20 and the inner hull 2 which occupy the opening portion H. Further, the adaptor 10 may be formed of the same material as the inner hull 2. The adaptor 10 may be formed of, for example, a metallic material such as stainless steel. The adaptor 10 may be arranged on the same plane with the inner hull 2.

The cover 20 has a plurality of through-holes 2*a* corresponding to each pipe P of the pump tower installed at the storage tank 1. Here, the cover 20 may have the through-holes 2*a* for a liquid pipe, a valve, and various layer equipment as well as the pipes of the pump tower for loading and unloading the liquid cargo described above. The cover 20 is disposed at the remaining area S2 (referring to FIG. 4) of the opening portion H formed between the other side of the adaptor 10 and the inner hull 2 disposed at the stem side. At this time, connection portions of the adaptor 10, the inner hull 2 and the cover 20 may be connected with each other by a welding operation W. That is, contact portions between the one side of the adaptor 10 and the inner hull 2 disposed at the stern side, between the other side of the adaptor 10 and the cover 20 and between the cover 20 and the inner hull 2 disposed at the stem side are connected by the welding operation W.

Further, the cover 20 supports the pipes P while closing the opening H, and may be configured of a flat plate having a smaller surface area than the opening portion H. The cover 20 may be disposed on the same plane with the adaptor 10 and the inner hull 2. The cover 20 may include a first area S3 which is in contact with the other side of the adaptor 10 and has the through-holes 2*a*, and a second area S4 which extends from the first area S3 and is in contact with the inner hull 2 disposed at the stem side. Here, the first area S3 has a cover insulation board 30 provided thereunder and formed under the first area S3.

The cover insulation board 30 may be formed in a plurality of insulation blocks. Each insulation block includes a first protective plate 31 bonded under the first area S3 by an adhesive M such as mastic, an insulation member 32 provided under the first protective plate 31, and a second protective plate 33 bonded under the insulation member 32. The cover insulation board 30 is disposed on the same plane with an upper insulation board 70 and a connection board 80 which will be described later.

The insulation layer 40 is disposed between a lower insulation board 50 and the cover insulation board 30 which are respectively provided at the inner hull 2 disposed at the stern side and the inner hulls 2 disposed at the stem side. The lower insulation board 50 which is provided under the inner hull 2 disposed at the stern side may be disposed at the corner side of the storage tank 1, may extend to a predetermined range under the adaptor 10, and then may be bonded by the adhesive M. The lower insulation board 50 which is provided under the inner hull 2 disposed at the stem side may extend to a predetermined portion of the second area S4 of the cover 20 and then may be bonded by the adhesive M.

At this time, a subsidiary secondary barrier 62 overlaps and is bonded to the adjustment closing portion 102 and a main secondary barrier 61 provided under the lower insulation board 50, thereby forming a sealed structure. Since the main secondary barrier 61 and the subsidiary secondary barrier 62 have very thin thicknesses, a step difference is hardly generated therebetween, and the main secondary barrier 61 and the subsidiary secondary barrier 62 may be arranged on the same plane.

Further, the connection board 80 is provided under the subsidiary secondary barrier 62 to be disposed between the upper insulation board 70 under the main secondary barrier 61 and the cover insulation board 30.

The insulation layer 40 is formed in a plurality of insulation blocks 41 to 43. A first insulation block 43 of the insulation blocks 41 to 43, both sides of which is enclosed by the other insulation blocks 41 and 42 in contact with the cover insulation board 30 and the lower insulation board 50, is bonded under the adaptor 10 and the second area S4 by the adhesive M. Here, for example, the insulation blocks 41 and 42 may be formed in a glass wool type or the like.

The lower insulation board 50 is disposed between the inner hull 2 and the main secondary barrier 61, and includes a lower protective plate 51 and a lower insulation member 52. The lower protective plate 51 may be formed of, for example, a material such as plywood, and the lower insulation member 52 may be formed of, for example, a polyurethane form material to protect the hull from a cryogenic fluid. The lower insulation member 52 is bonded under the lower protective plate 51 by an adhesive (e.g., glue or the like).

Also, the upper insulation board 70 is disposed between a primary barrier 90 and the main secondary barrier 61, and includes an upper insulation member 72 and an upper protective plate 71. The upper insulation member 72 may be formed of the same material as the lower insulation member 52, and the upper protective plate 71 may be formed of the same material as the lower protective plate 51.

Further, the primary barrier 90 is a portion which is directly in contact with the LNG, and is thus formed to have high gas-tightness. Also the primary barrier 90 may be formed to maintain lower in-plane stiffness, such that a welded portion is prevented from being broken by thermal stress caused by thermal contraction generated when in contact with the cryogenic LNG. The primary barrier 90 is formed to have a bellows portion 90*a*, and the bellows portion 90*a* is deformed in a certain range to reduce the thermal stress at the welded portion, when thermal contraction is generated. The primary barrier 90 may be formed of the metallic material such as stainless steel.

Further, for example, the main secondary barrier 61 and the subsidiary secondary barrier 62 may be configured of a plurality of sheets formed of a metallic material such as stainless steel, aluminum, brass and zinc. As another example, the main secondary barrier 61 may be configured of a composite material sheet formed of a metal sheet and a fiber reinforced composite material.

Further, the connection board 80 includes a connection protective plate 81 and a connection insulation member 82. The connection insulation member 82 may be formed of the same material as the lower insulation member 52, and the connection protective plate 81 may be formed of the same material as the lower protective plate 51.

The adjustment closing portion 102 is fixedly bonded to a vertical closing portion 103, which is vertically bonded under the adaptor 10 and the cover 20, so as to adjust a height thereof. At this time, the adjustment closing portion 102 is fixedly installed at the vertical closing portion 103 to be disposed on the same plane with the adjacent insulation layers 40 and 50. The vertical closing portion 103 may be integrally formed with the adaptor 10 and the cover 20, or may be separately manufactured and then fixed by the welding operation. The adjustment closing portion 102 may be fixed to the vertical closing portion 103 by the welding operation, and may have an L-shaped cross section. However, the adjustment closing portion 102 is not limited to the L-shaped cross section, and may have various shapes to be disposed on the same plane with the subsidiary secondary barrier 62.

Figure 3:
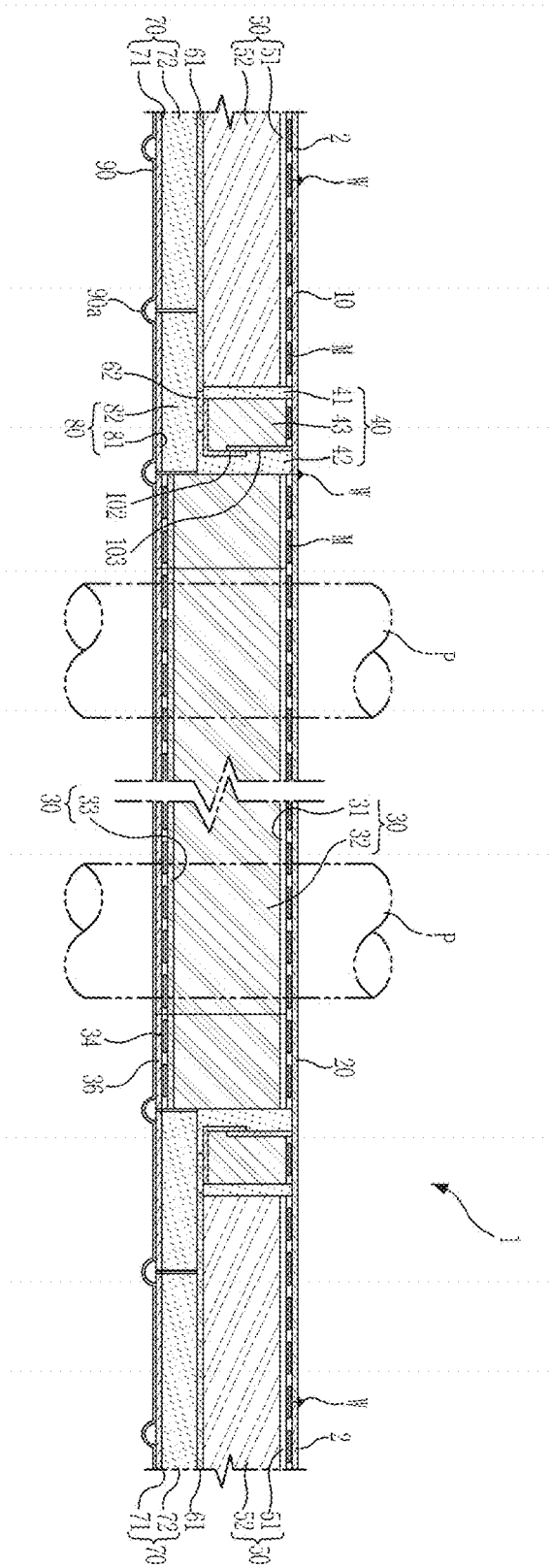
FIG. 3 is a cross-sectional view illustrating another example of the pump tower installation structure of the LNG storage tank of FIG. 2.

FIG. 3 is a cross-sectional view illustrating another example of the pump tower installation structure of the LNG storage tank of FIG. 2.

As illustrated in FIG. 3, as another example, the cover insulation board 30 may include an adjustment protective plate 36 bonded under the second protective plate 33 by an adhesive layer 34. This is to perform the height adjustment using the adjustment protective plate 36 before the adhesive layer 334 is cured, such that the cover insulation board 30 and the connection board 80 are disposed on the same plane.

Hereinafter, manufacturing processes of the pump tower installation structure of the storage tank 1 will be described through FIGS. 4 to 8, based on the descriptions of FIGS. 1 and 2.

FIGS. 4 through 8 are cross-sectional views illustrating manufacturing processes of the pump tower installation structure of FIG. 2.

Figure 4:
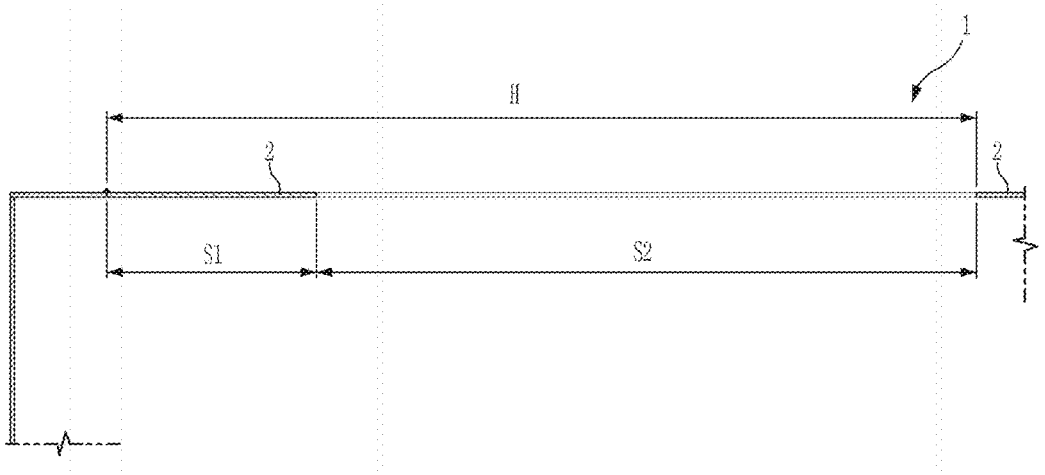
FIGS. 4 through 8 are cross-sectional views illustrating manufacturing processes of the pump tower installation structure of FIG. 2.

As illustrated in FIG. 4, the adaptor 10 of which one side is connected with the inner hull 2 disposed at the stern side is disposed at the predetermined area 51 of the opening portion H. Here, the one side of the adaptor 10 and the inner hull 2 disposed at the stern side are coupled by the welding operation.

Figure 5:
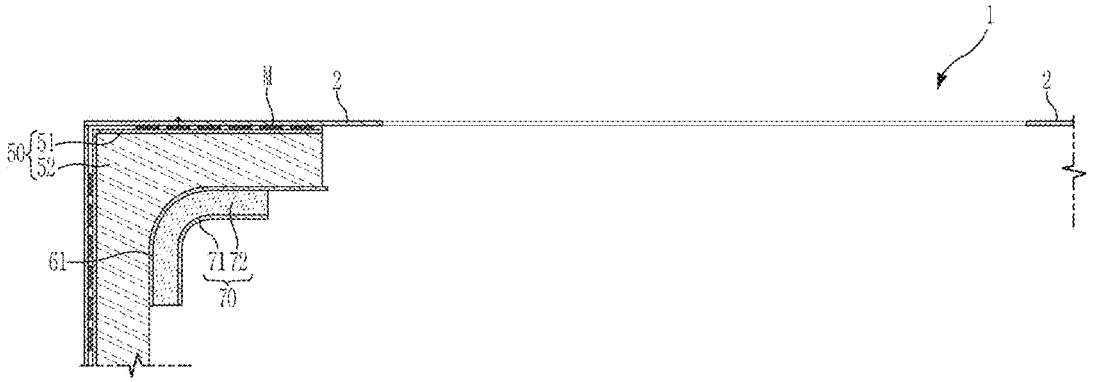

As illustrated in FIG. 5, the lower insulation board 50, the main secondary barrier 61 and the upper insulation board 70 are installed at the corner side of the inner hull 2 disposed at the stern side. Here, inner surfaces of the lower insulation board 50, the main secondary barrier 61 and the upper insulation board 70 disposed at the corner side of the storage tank 1 are formed in curved shapes, thereby preventing concentration of the stress.

Figure 6:
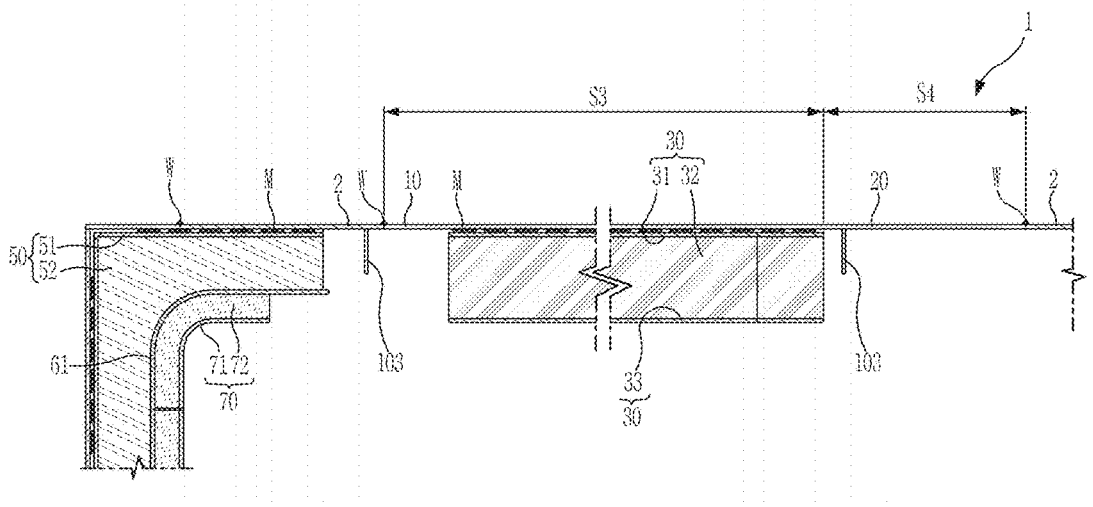

As illustrated in FIG. 6, the cover insulation board 30 is provided at the lower side thereof, and the cover 20 including the first area S3 having the through-holes 2*a* and the second area S4 extending from the first area S3 and in contact with the inner hull 2 disposed at the stem side is disposed at the remaining area S2 of the opening portion H. Here, the contact portions among the adaptor 10, the cover 20 and the inner hull 2 may be coupled by the welding operation. Further, the cover 20 may be installed in a state in which the insulation block B (referring to FIG. 7) of the cover insulation board 30, which is in contact with a boundary surface of the adaptor 10, is excluded. Thus, the insulation material is prevented from being damaged by welding heat. The vertical closing portion 103 is bonded under the adaptor 10 and the cover 20.

Figure 7:
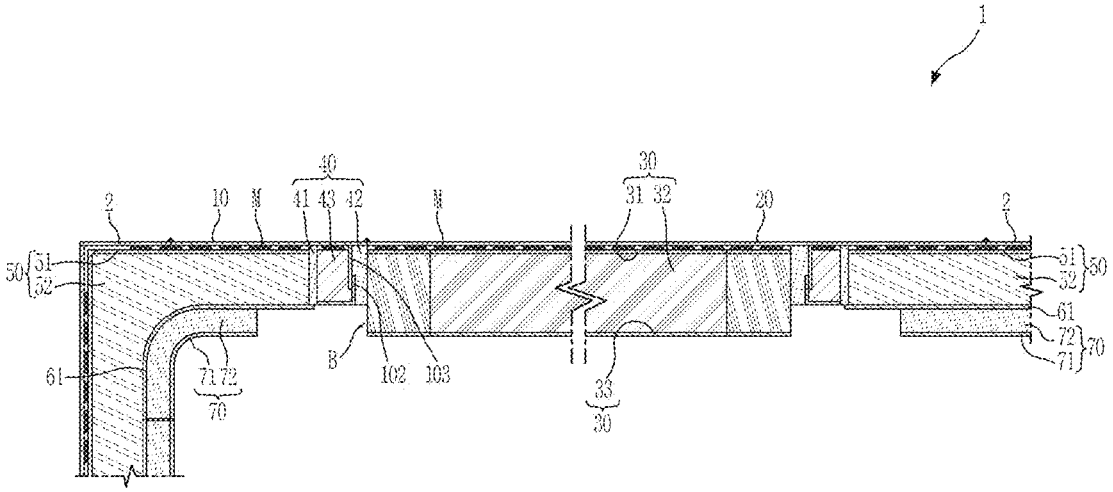
Figure 8:
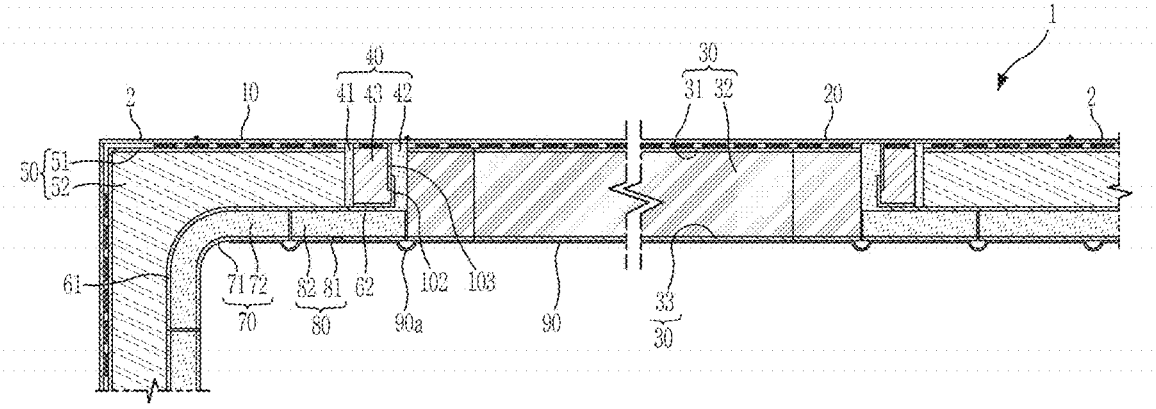

Then, as illustrated in FIGS. 7 and 8, an operation of installing at least one barrier and an insulation operation are performed around the cover insulation board 30. To this end, first, the lower insulation board 50, the main secondary barrier 61 and the upper insulation board 70 are installed under the inner hull 2 disposed at the stem side.

The insulation layer 40 is disposed between the lower insulation board 50 and the cover insulation board 30 which are provided under the inner hull 2 disposed at the stern side and the inner hull 2 disposed at the stem side. At this time, the first insulation block 43 of the insulation layer 40 is bonded under each of the adaptor 10 and the second area S4 of the cover 20 by the adhesive M to be in contact with the vertical closing portion 103. Further, another insulation block 41 of the insulation layer 40 is disposed between the first insulation block 43 and the lower insulation board 50. The last block 42 of the insulation layer 40 is disposed between the corresponding blocks B of the first insulation block 43 and the cover insulation board 30 in a state in which the adjustment closing portion 102 is fixed to the vertical closing portion 103, and the insulation block B of the cover insulation board 30, which is in contact with the boundary surface of the adaptor 10 is installed.

Then, the subsidiary secondary barrier 62 is bonded on the main secondary barrier 61 and the adjustment closing portion 102 provided under the lower insulation board 50.

Then, the connection board 80 is disposed under the subsidiary secondary barrier 62 to be disposed between the upper insulation board 70 and the cover insulation board 30 provided under the main secondary barrier 61 and to be on the same plane with the upper insulation board 70.

Then, the primary barrier 90 is stacked on the lower surface of the cover insulation board 30, the connection board 80 and the upper insulation board 70 which are one the same plane.

As described above, a peripheral portion of the cover insulation board 30 under the cover 20 formed at a lower side of the opening H is insulated, and thus an insulation structure of the storage tank 1 may be effectively finished at the inner hull 2.

Figure 9:
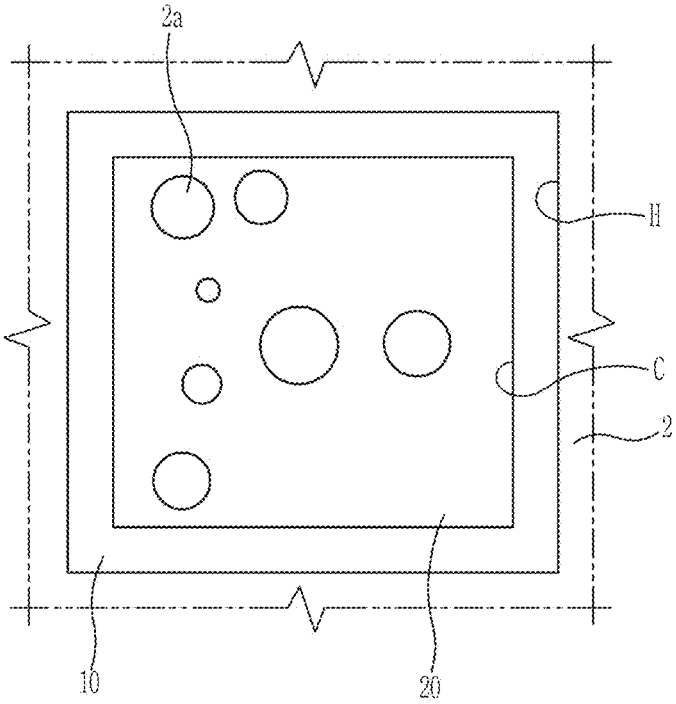
FIG. 9 is a plane view of a pump tower installation structure of an LNG storage tank in accordance with a second embodiment of the present invention.
Figure 10:
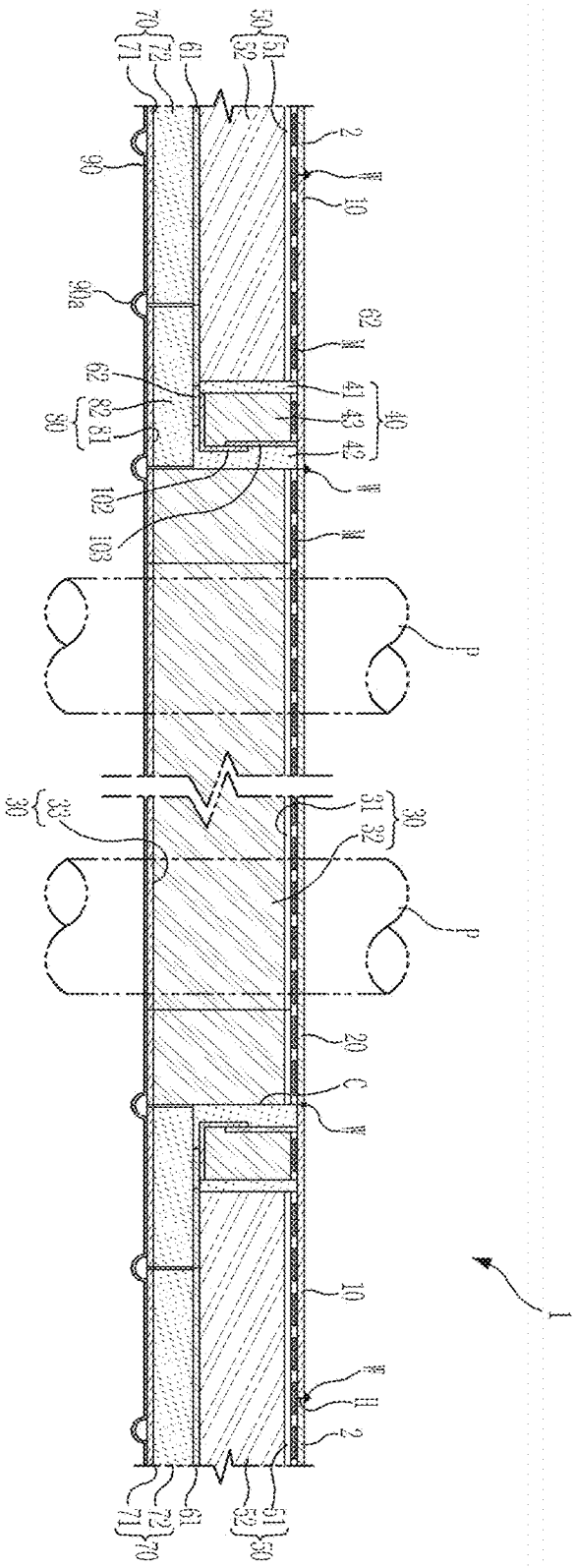
FIG. 10 is a cross-sectional view of the pump tower installation structure of the LNG storage tank of FIG. 9.

FIG. 9 is a plane view of a pump tower installation structure of an LNG storage tank in accordance with a second embodiment of the present invention, and FIG. 10 is a cross-sectional view of the pump tower installation structure of the LNG storage tank of FIG. 9.

As illustrated in FIGS. 9 and 10, an adaptor 10 according to a second embodiment of the present invention is formed in a frame shape having a cover hole portion C to which the cover 20 is bonded, and is fixedly installed around the opening portion H of the inner hull 2. At this time, the adaptor 10 may be bonded to a peripheral portion of the opening portion H (i.e., the inner hull 2) by the welding operation W. The cover hole portion C formed at the adaptor 10 is formed in a through-hole shape corresponding to the cover 20. The cover hole portion C corresponds to the remaining area of the opening portion H other than the predetermined area of the opening portion H occupied by the adaptor 10. The adaptor 10 may be manufactured by a post-process in which the cover 20 is disposed at a center portion of the opening portion H of the inner hull 2, and then an area which is not occupied by the cover, i.e., the remaining area between a circumference of the cover 20 and the opening portion H, is measured to provide a size corresponding to the measured area.

The cover 20 may be bonded to the cover hole portion C of the adaptor 10 by the welding operation W in a state in which the adaptor 10 is fixed to the peripheral portion of the opening portion H. As illustrated in FIGS. 1 and 2, the cover 20 has the cover insulation board 30 provided thereunder and formed under the opening portion H. At this time, the insulation operation is performed around the cover insulation board 30. That is, the adaptor 10 is disposed at the opening portion H, the cover 20 is bonded to the cover hole C of the adaptor 10, and then the operation of installing at least one barrier and the insulation operation are performed around the cover insulation board 30. Since the descriptions relevant to the insulation layer (member) and the barrier installed around the cover insulation board 30 were described in FIGS. 1 and 2, and the insulation operation was described in FIGS. 7 and 8, the detailed descriptions thereof will be omitted. The contact portions of the adaptor 10, the inner hull 2 and the cover 20 may be bonded by the welding operation W.

The cover 20 may be supported in a state in which the opening portion H of the inner hull 2 is closed by the structure of the adaptor 10 as described above. At this time, the plurality of pipes P provided to be fixed to the cover 120 are fixed to the inner hull 2 and uprightly installed in the storage tank 1.

Although a few embodiments of the present invention have been shown and described, it would be appreciated by those skilled in the art that changes may be made in these embodiments without departing from the principles and spirit of the invention, the scope of which is defined in the claims and their equivalents.

The invention claimed is:

1. A pump tower installation structure of a liquefied natural gas (LNG) storage tank, comprising:

an adaptor disposed at a stern side of an opening portion formed at an inner hull disposed on an upper side of the LNG storage tank;

a cover having through-holes corresponding to pipes of the pump tower installed at the storage tank, and disposed at a remaining area of the opening portion to be connected with the adaptor;

a cover insulation board disposed under the cover;

a lower insulation board disposed under the inner hull at the stern side;

an insulation layer disposed under the adaptor;

a vertical closing portion vertically installed under the adaptor to be in contact with the insulation layer; and an adjustment closing portion fixedly installed at the vertical closing portion to be disposed on the same plane with the lower insulation board;

wherein the insulation layer is provided between the cover insulation board and the lower insulation board, and the lower insulation board is provided at the corner of the storage tank under the inner hull, and extends to a predetermined range under the adaptor.

2. The pump tower installation structure according to claim 1, wherein the adaptor is formed of a flat plate, one side of the adaptor is connected to the inner hull at the stem side, and the cover is disposed at the remaining area of the opening portion formed between the other side of the adaptor and the inner hull at a stem side.

3. The pump tower installation structure according to claim 1, wherein the adaptor is formed in a frame shape having a cover hole portion to which the cover is bonded, and fixedly installed at a peripheral portion of the opening portion.

4. The pump tower installation structure according to claim 1, wherein the peripheral portion of the cover insulation board is insulated.

5. The pump tower installation structure according to claim 4, wherein the cover insulation board comprises a plurality of insulation blocks, and the insulation block comprises a first protective plate, an insulation member provided under the first protective plate, and a second protective plate attached under the insulation member.

6. The pump tower installation structure according to claim 5, wherein an adhesive layer and an adjustment protective plate attached under the second protective plate by the adhesive layer are provided under the second protective plate.

7. The pump tower installation structure according to claim 1, wherein the adjustment closing portion has an L-shaped cross section.

8. The pump tower installation structure according to claim 1, further comprising a subsidiary secondary barrier overlapping the adjustment closing portion and a main secondary barrier provided under the lower insulation board, and a connection board disposed under at least one of the main secondary barrier, the subsidiary secondary barrier and the insulation layer such that the connection board is disposed on the same plane with an upper insulation board under the main secondary barrier.

9. The pump tower installation structure according to claim 8, wherein a primary barrier is stacked on a lower surface of the upper insulation board, the connection board and the cover insulation board which are on the same plane.

* * * * *